US006062639A

United States Patent [19]

Hill

[11] Patent Number: 6,062,639

[45] Date of Patent: May 16, 2000

[54] FOLDING CHAIR WITH INTEGRAL SAFETY FEATURE

[76] Inventor: Steven G. Hill, 522 Palmer La., Menlo Park, Calif. 94025

[21] Appl. No.: 09/318,092

[22] Filed: May 25, 1999

[51] Int. Cl.[7] ..... A47C 4/00

[52] U.S. Cl. ..... 297/40; 297/39

[58] Field of Search ..... 297/16.1, 19, 39, 297/40, 53, 378.12

[56] References Cited

U.S. PATENT DOCUMENTS

| | | | |
|---|---|---|---|
| 4,613,185 | 9/1986 | Marchesini | 297/39 |
| 4,635,998 | 1/1987 | Hickey | 297/39 X |
| 5,707,105 | 1/1998 | Liu | 297/40 |
| 5,947,553 | 9/1999 | Tseng | 297/39 |
| 5,964,500 | 10/1999 | Liu | 297/39 X |

*Primary Examiner*—Peter R. Brown
*Attorney, Agent, or Firm*—Goldstein & Canino

[57] ABSTRACT

A folding chair having a locking device for locking the chair in the open position so that it is safe for children. The chair has a frame including a seat, a back rest, and legs. The seat includes two parallel seat frame members. the back rest includes two parallel back rest members. The seat frame members are hingeably attached to the back rest members for selectively entering an open position wherein the seat frame members are substantially perpendicular to the back rest members, and a folded or closed position wherein the seat frame members extend substantially parallel to the back rest members. Each seat frame member has a seat frame member rear portion defined as the part of the seat frame member rearward of the back rest member. As the chair is folded the back rest member sweeps rearward, diminishing the size of the seat frame member rear portion. A locking device is pivotally attached at the seat frame member rear portion for selectively locking the chair by abutting the back rest member and preventing the back rest member from sweeping rearward, and thereby preventing the chair from folding.

8 Claims, 3 Drawing Sheets

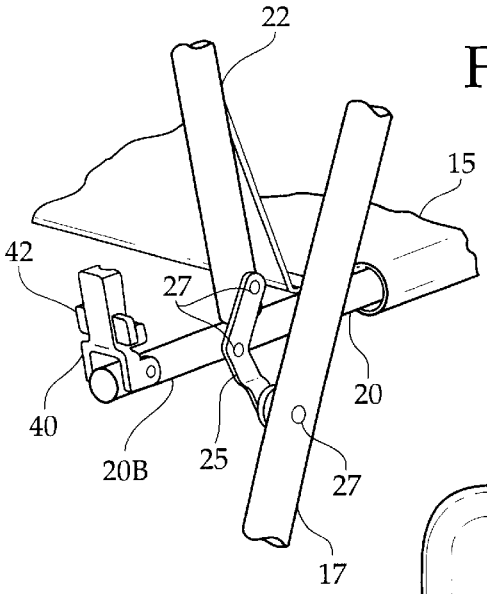
FIG. 3
FIG. 4
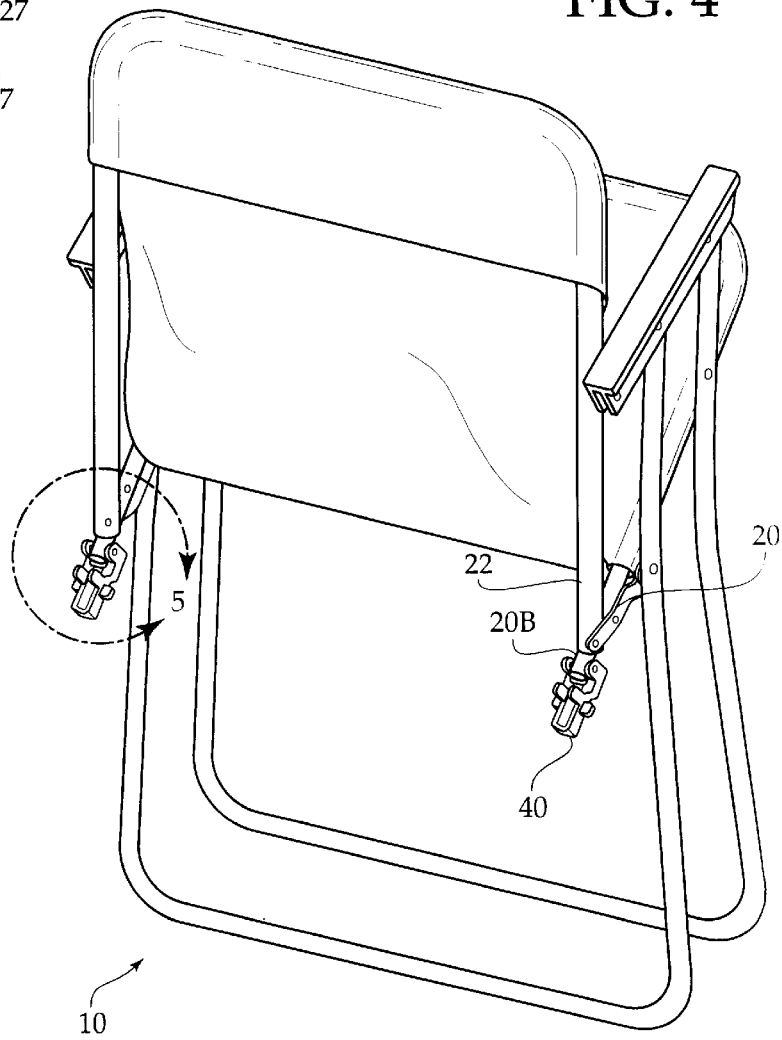

FOLDING CHAIR WITH INTEGRAL SAFETY FEATURE

BACKGROUND OF THE INVENTION

The invention relates to a folding chair with integral safety feature. More particularly, the invention relates to a children's folding chair which has a safety lock for preventing the child from closing the chair.

Children enjoy using and playing with scaled down versions of "adult" furniture. Miniature tables and chairs play a central role in a child's "pretend" play. Generally these toy furniture items are single piece plastic castings, which are extremely safe for children to play with.

However, children's folding chairs are also quite popular. The problem with folding chairs is that when they fold they create a great opportunity to pinch small fingers and skin in the various hinges and between frame members. Thus, frequent injuries occur when children are handling folding chairs which close unexpectedly, or because children try to close the chair without knowing where to keep their hands to avoid injury.

SUMMARY OF THE INVENTION

It is an object of the invention to produce a folding hair which is safe for use by small children. Accordingly, safety features are incorporated within the chair to prevent the chair from injuring a child.

It is another object of the invention to provide a folding chair which is capable of locking in the open position. Accordingly, a safety lock is provided on the chair frame which may be set to maintain the chair in the open position.

It is a further object of the invention to provide a safety lock which securely locks the chair in the open position while being used by a child, but which is easily unlocked by an adult. Accordingly, the safety lock is configured to be easily operated by adults, but is inconspicuous and difficult to operate by children.

It is a still further object of the invention that the safety lock works with existing folding chair designs. Accordingly, the safety lock is designed to be readily integrated with standard folding chair constructions.

The invention is a folding chair having a locking device for locking the chair in the open position so that it is safe for children. The chair has a frame including a seat, a back rest, and legs. The seat includes two parallel seat frame members, the back rest includes two parallel back rest members. The seat frame members are hingeably attached to the back rest members for selectively entering an open position wherein the seat frame members are substantially perpendicular to the back rest members, and a folded or closed position wherein the seat frame members extend substantially parallel to the back rest members. Each seat frame member has a seat frame member rear portion defined as the part of the seat frame member rearward of the back rest member. As the chair is folded the back rest member sweeps rearward, diminishing the size of the seat frame member rear portion. A locking device is pivotally attached at the seat frame member rear portion for selectively locking the chair by abutting the back rest member and preventing the back rest member from sweeping rearward, and thereby preventing the chair from folding.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 3 is a diagrammatic perspective view, showing the lock in the opened position, so that the chair can close.

FIG 4 is a diagrammatic perspective view, wherein the chair has been folded.

DETAILED DESCRIPTION OF THE PREFERRED EMBODIMENTS

Figure 1:
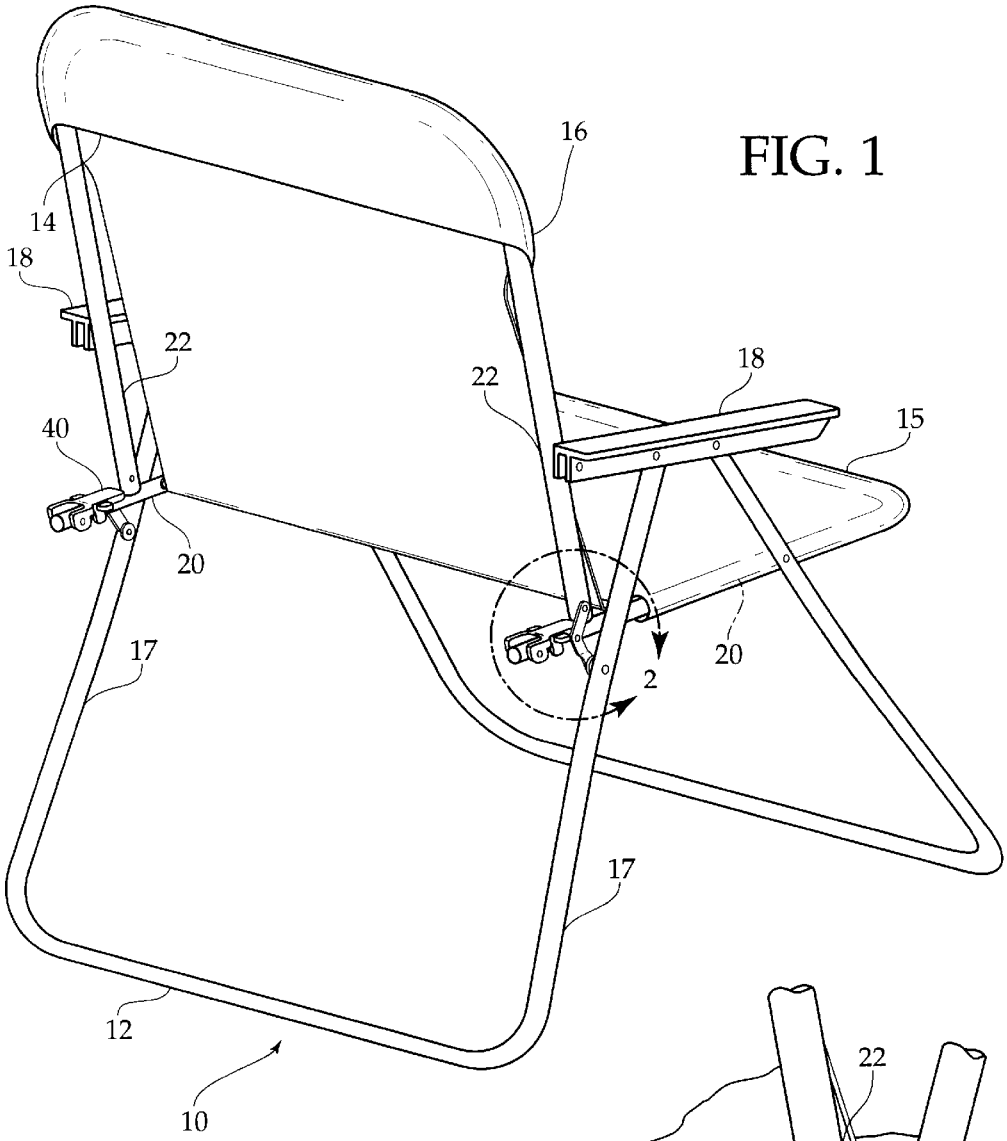
FIG. 1 is a diagrammatic perspective view, showing a chair having a pair of locking devices installed thereon.

FIG. 1 illustrates a chair 10 having a frame 12, and fabric covering 14 extending over the frame. The chair 10 includes a seat 15, a back rest 16, legs 17, and arm rests 18. The seat 15 is a generally tubular construction, which includes a pair of parallel seat frame members 20. The back rest 16 includes a pair of parallel back rest members 22.

Referring to FIG. 3, each of the back rest members 22 are attached to one of the seat frame members 20 and one of the legs 17 by one of two compound hinges 25. The compound hinge allows the chair to vary between and open position wherein the seat frame members 20 extend substantially horizontally and substantially perpendicular to the back rest members 22; and a closed position wherein the seat frame members 20 extend substantially parallel to the back rest members 22. Thus, each compound hinge 25 has three pivot points 27. One pivot point is attached to one of the back rest members 22, one pivot point is attached to one of the seat frame members 20, and one pivot point is attached to one of the legs 17. Each compound hinge 25 is substantially L-shaped, wherein the pivot point attached to the seat frame member 20 is at the middle thereof.

When the chair is in its open position, the back rest members 22 press downward against the seat frame members 20 as seen in FIG. 3. In fact, it is the upward force of the seat frame members 20 against the back rest members 22 which keeps the chair sturdy when the weight is applied upon the eat 15. The seat frame members 20 each have a seat frame ember back portion 20B, which is defined as a portion of the seat frame member 20 which is rearward of the back rest member 22. The size of the seat frame member back portion 20B varies in size, depending on whether the chair is in the open position, or in the closed position. The difference in size of the seat frame member back portion 20B is perhaps best seen when comparing FIG. 3, wherein the chair 10 is fully open, and FIG. 4, when is chair 10 is substantially folded or closed. The reason why the seat frame member back portion 20B varies in size, is because the compound hinge 25 causes the back rest member 22 to sweep rearward along the seat frame member 20 as the chair is closed. It is this tendency which allows the locking feature of the present invention to work, as will be described hereinafter.

Figure 2:
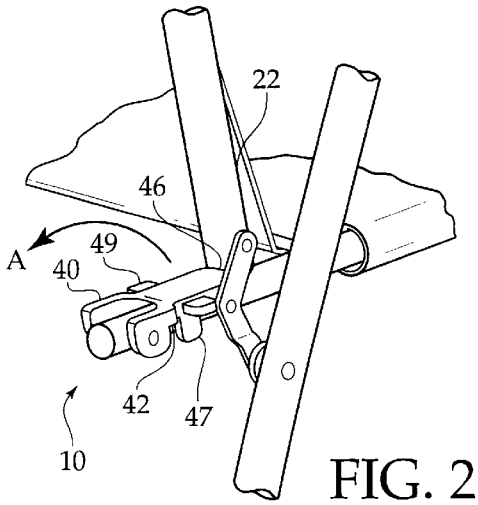
FIG. 2 is an enlarged perspective view, taken generally in the area of circle 2 in FIG. 1. The lock is shown in the locked position, with arrow A indicating the direction in which the lock is opened.

According to the present invention, the chair has a pair of locking devices 40 pivotally mounted at the seat frame member back portion 20B. Each locking device 40 comprises a locking body 42 which is pivotable between a locking position where it extends along the seat frame member back portion 20B and abuts the back rest member 22 as seen in FIG. 1 and FIG. 2; and unlocked position wherein it is pivoted out of the way so that the chair can close, as seen in FIG. 3 and FIG. 4.

Figure 5:
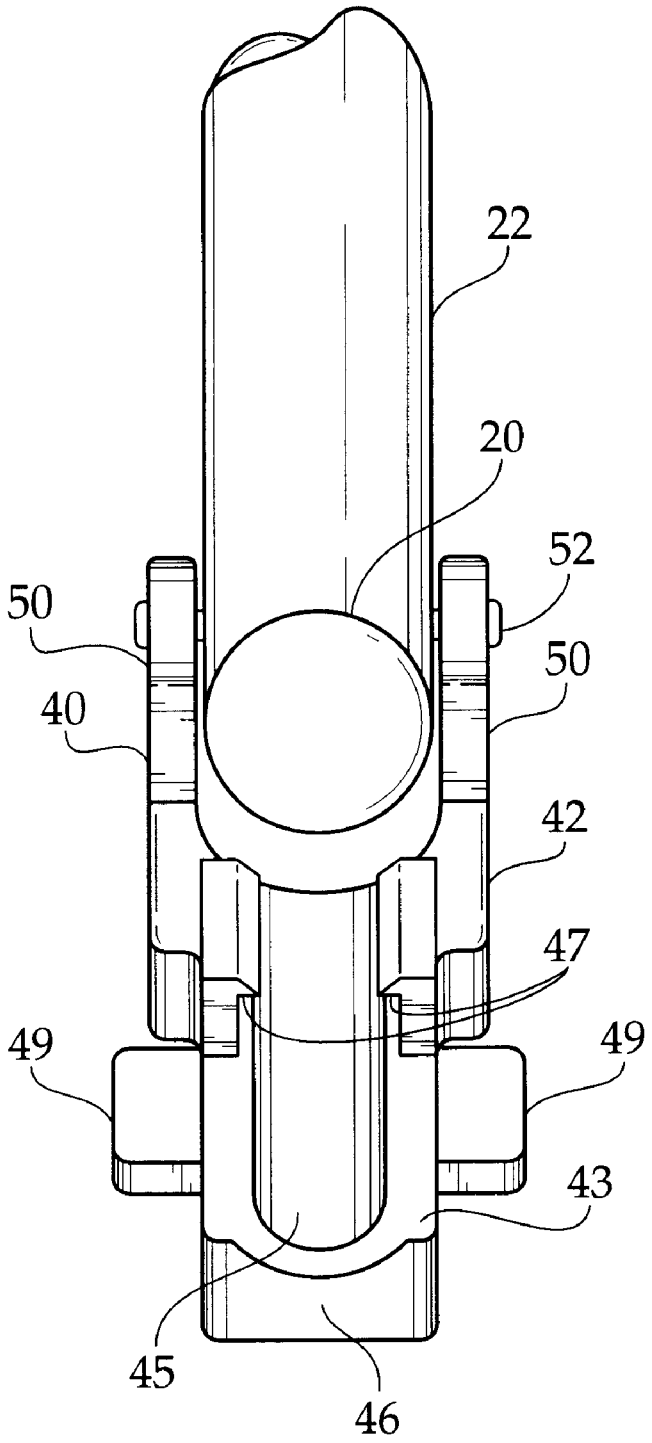
FIG 5 is an enlarged diagrammatic perspective view, taken generally in the area of circle 5 in FIG. 4.

FIG. 5 shows details of one of the locking devices 40. The locking body 42 has an underbelly 43 having a hollow 45 which matches the curvature of the seat frame member 20, which is shown fully foreshortened in FIG. 5, when locked in place. Protruding from the underbelly 43 are a pair of latches 47 which allow the locking body 42 to snap onto the seat frame member 20, and hold the locking body 42 onto the seat frame member 20 with sufficient force that only an adult can unsnap the latches 47 to unlock the locking device 40. A pair of handle slabs 49 extend laterally from locking body 42 to allow a user to easily lock and unlock the locking device 40. The locking body 42 is attached to the seat frame member 20 with a pair of brackets 50 which engage opposite sides of the seat frame member 20. A hinge pin 52 extends through both brackets 50 and through the seat frame member 20 to allow the locking body 42 to pivot thereon. The locking body 42 has a locking body front 46 which abuts the back rest member 22 when the locking device 40 is in the locked position.

In use, once the chair is fully open, each of the locking devices 40 are pivoted until the latches 47 snap onto the seat frame member 20, the hollow 45 of the underbelly 43 rests along the seat frame member back portion 20B, and the locking body front 46 abuts the back rest member 22. The child can then safely use the chair 10, and cannot intentionally or inadvertently close the chair. To close the chair, the locking body 42 is grasped by the handle slabs 49, and upward pressure is exerted thereupon in the direction of arrow A in FIG. 2, to free the latches 47 from the seat frame member 20 and free the locking body front 46 from the back rest member 22. The chair 10 can then be folded closed.

In conclusion, herein is presented a chair having a safety locking feature which prevents the chair from closing when the locking feature is engaged, and thereby makes the chair safe and suitable for children.

What is claimed is:

1. A folding chair, comprising:

a frame, having a back rest comprising a pair of parallel back rest members, a seat comprising a pair of parallel seat frame members, and legs, each of the seat frame members is adjacent to one of the back rest members, the frame having an open position wherein the seat extends substantially perpendicular to the back rest and a folded position wherein the seat extends substantially parallel to the back rest, the seat frame members each having a seat frame member back portion defined as a portion of the seat frame member rearward of the back rest member adjacent to said seat frame member, the back rest member resting upon the seat frame member when the chair is in the open position, the back rest member sweeping rearward and diminishing the size of the seat frame member back portion as the chair is altered from the open position to the folded position; and at least one locking device, pivotally attached to the seat frame member rear portion, for selectively locking the chair in the open position by abutting against the back rest member adjacent to said seat frame member when the chair is in the open position for preventing the chair from folding while said locking device is so engaged by preventing the back rest member from sweeping rearward.

2. The chair as recited in claim 1, wherein the locking device comprises a locking body having an underbelly having a pair of latches extending therefrom for engaging the seat frame member rear portion and requiring an upward force to overcome the latches and release the locking body from the seat frame member rear portion.

3. The chair as recited in claim 2, wherein the seat frame member is tubular, and wherein the underbelly has a hollow which rests against the seat frame member and matches its curvature when the locking device is locked.

4. The chair as recited in claim 3, wherein the locking body further comprises a locking body front which abuts the back rest member when the locking device is in the locked position.

5. The chair as recited in claim 4, wherein the locking body further comprises a pair of handle flanges extending laterally outward therefrom.

6. The chair as recited in claim 5, wherein the locking body has a pair of brackets which engage opposite sides of the seat frame member rear portion, and wherein the locking body is mounted to the seat frame member rear portion by a hinge pin extending through both brackets and through the seat frame member rear portion.

7. The chair as recited in claim 6, further comprising a pair of compound hinges, each compound hinge having three pivot points, one of the pivot points attached to one of the seat frame members, one of the pivot points attached to one of the back rest members, and one of the pivot points attached to one of the legs.

8. The chair as recited in claim 7, having two locking devices, one locking device pivotally mounted to each of the seat frame members.

* * * * *